US009968952B2

(12) United States Patent
Ott et al.

(10) Patent No.: US 9,968,952 B2
(45) Date of Patent: May 15, 2018

(54) PAINT-SPRAY LINE

(71) Applicant: LACTEC GMBH, Rodgau (DE)

(72) Inventors: Winfried Ott, Rodgau (DE); Volker Weiss, Frankfurt (DE)

(73) Assignee: LACTEC GMBH, Rodgau (DE)

( * ) Notice: Subject to any disclaimer, the term of this patent is extended or adjusted under 35 U.S.C. 154(b) by 0 days. days.

(21) Appl. No.: 13/782,851

(22) Filed: Mar. 1, 2013

(65) Prior Publication Data

US 2013/0228123 A1 Sep. 5, 2013

(30) Foreign Application Priority Data

Mar. 2, 2012 (EP) ..... 12001431

(51) Int. Cl.
*B05B 9/03* (2006.01)
*B05B 12/14* (2006.01)

(52) U.S. Cl.
CPC ..... *B05B 9/035* (2013.01); *B05B 12/14* (2013.01); *B05B 12/149* (2013.01); *B05B 12/1481* (2013.01)

(58) Field of Classification Search
None
See application file for complete search history.

(56) References Cited

U.S. PATENT DOCUMENTS

| | | | | |
|---|---|---|---|---|
| 4,516,700 | A | 5/1985 | Guzowski | |
| 5,655,896 | A * | 8/1997 | Konieczynski | B05B 5/1633 239/691 |
| 5,738,728 | A | 4/1998 | Yoon et al. | |
| 2003/0127542 | A1 | 7/2003 | Cooper | |
| 2005/0173018 | A1* | 8/2005 | Herre et al. | 141/91 |
| 2010/0012025 | A1* | 1/2010 | Herre et al. | 118/300 |
| 2012/0055570 | A1* | 3/2012 | Ott et al. | 137/597 |
| 2013/0284833 | A1* | 10/2013 | Fritz et al. | 239/690 |

FOREIGN PATENT DOCUMENTS

| | | | | |
|---|---|---|---|---|
| DE | 102005060959 | A1 | 4/2007 | |
| DE | 102006002389 | | 7/2007 | |
| EP | 1142649 | B1 | 10/2001 | |
| WO | WO 2003/095106 | A2 | 11/2003 | |
| WO | WO 2008/071273 | A2 | 11/2007 | |
| WO | WO2011138048 | * | 11/2011 | B05B 17/06 |

* cited by examiner

*Primary Examiner* — Jethro M Pence
(74) *Attorney, Agent, or Firm* — Sheridan Ross PC

(57) ABSTRACT

A paint-spray line comprising a number of sprayers which are provided to discharge paint onto an item to be coated and are connected to a paint supply unit via a common main supply line is also suitable, to a particular extent and at an expense kept particularly low, for a need-based provision of individual quantities of paint which are kept at a particular minimum. For this purpose, the conveying device, provided for feeding paint into the main supply line is configured according to the invention as a single-piston pump.

17 Claims, 4 Drawing Sheets

PAINT-SPRAY LINE

CROSS REFERENCE TO RELATED APPLICATIONS

Figure 1:
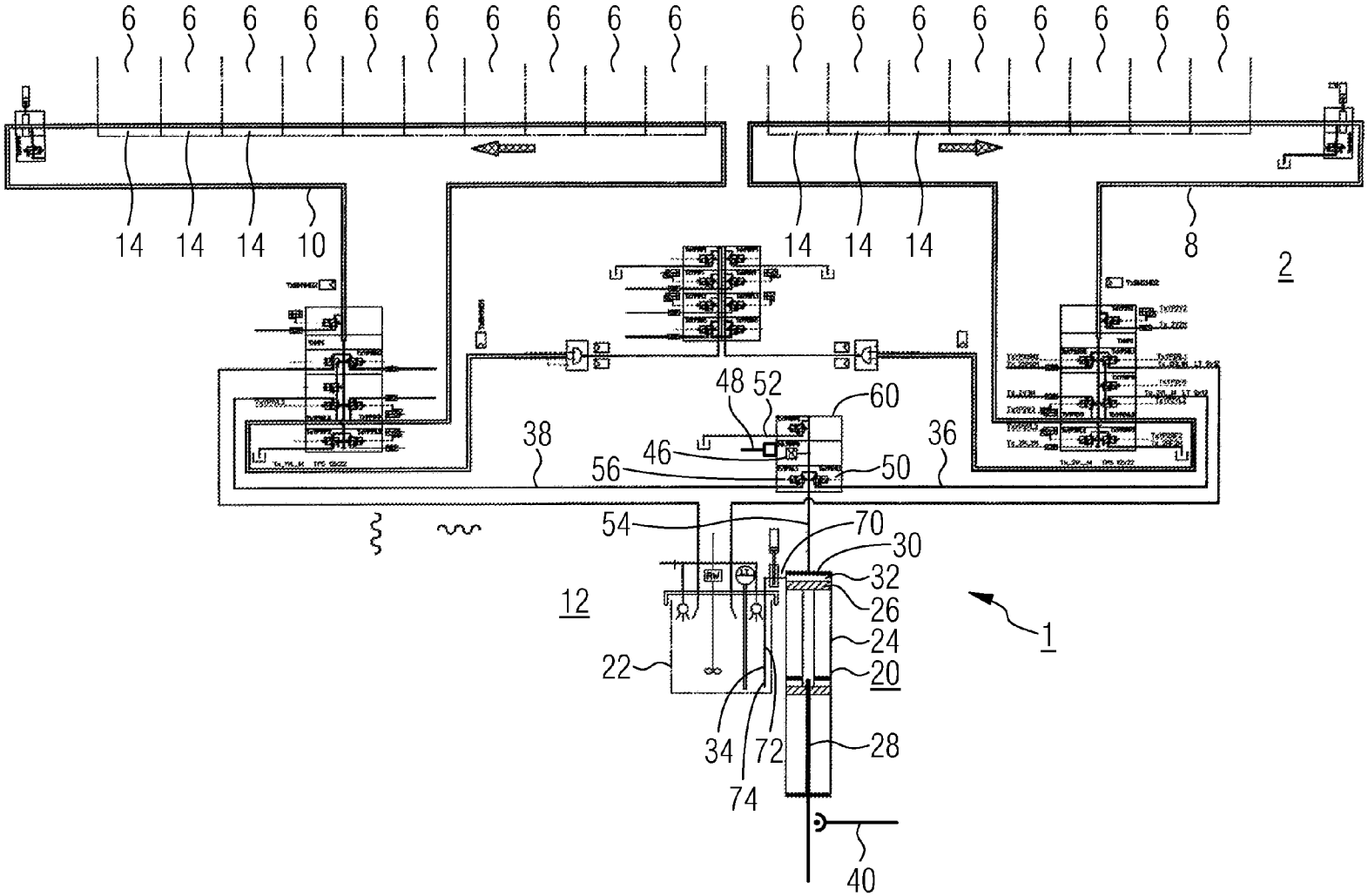

This application claims the benefit of European Patent Application No. 12 001 431.1 filed Mar. 2, 2012, the disclosure of which is incorporated herein by reference.

The invention relates to a paint-spray line comprising a number of sprayers which are provided to discharge paint onto an item to be coated and are connected to a paint supply unit via a common supply line system, in particular via a common main supply line or also with separate branch lines.

Paint-spray lines of this type are used, for example, for coating or painting the bodywork of motor vehicles. For the supply of various sprayers which, for example, are arranged in tandem in the manner of a painting line and can be provided to apply paint in different stages, a main supply line for feeding the paint is usually provided which can be guided, for example, in the manner of what is known as ring line along a corresponding paint booth or around said paint booth. Branch lines are then diverted off this main supply line or ring line, with the interconnection of suitable components, such as valves or the like, the branch lines opening into the respective sprayers and being able to convey the paint thereto. Optionally, particularly in the case of an installation which is provided for coating with different coloured paints, a plurality of ring lines can also be provided, in which case suitable colour changers can be connected into the system at the junction of the respective branch lines. Alternatively, subject in particular to the distances between the paint supply unit and the sprayers or colour changers, it is also possible to use individual branch lines, connected immediately downstream of the paint supply unit, to the removal points, instead of using ring lines.

The main supply line, i.e. in particular the ring line, is usually connected on the input side to a paint supply unit, via which the paint material can be fed from a paint container, for example from an exchangeable paint bucket or the like, into the main supply line via a feed pump or a conveying device. When the main supply line is configured as a ring line, this can be connected at the end to a paint reservoir, again also in the manner of a circular or annular guidance, so that the recirculated paint conveyed in the ring line can flow back again on the outlet side into the paint reservoir. Alternatively, the main supply line can also be configured as a branch line and can be connected to the paint reservoir only on the inlet side.

Installations of this type are mostly used in large-batch production, where comparatively large numbers of components, such as vehicle bodies, are painted and coated with unvarying standard shades of colour. Thus, with an operating mode of this type, a virtually constant paint flow-through can be maintained throughout the entire system, without necessitating the rejection of residual paint or the recovery of quantities of paint in the system, due to a change of media or the like.

However, on the other hand, systems of this type can also be used for processing very small batches or for an individual production of single components, for example during the application of a special paint for a customised motor vehicle. For the discharge of quantities of paint adjusted to such small workpiece numbers or the like, it is possible to provide a decentralised supply of individual paint reservoirs in the immediate discharge region, i.e. close to the individual sprayers. However, it is comparatively complicated to handle a system of this type and a central paint supply and thereby an automation of the procedures is ruled out.

To overcome this disadvantage, it is known from EP 1 142 649 B1 to specifically upgrade a paint-spray line of the type mentioned above for an automatable and need-based processing of individual pieces or also of very small batches. In this respect, it is provided to feed, in a manner adapted to requirements and thus specifically, small quantities of paint which are also adjusted to a small paint requirement into the ring line or into the main supply line using the pigging method, so that the resulting residual quantities of paint which cannot be further utilised can be kept at a comparatively low level.

However, in respect of an increasing individualization also in the colouring of vehicle components and the like, it has been found that the need for very small quantities of paint with frequent colour changes also has to be taken into account in many processing scenarios. For example, during the production of individualized workpieces or the like, it may also be necessary to carry out reworking tasks, as required, during the painting process in respect of particularly high quality requirements, so that a particularly flexible provision of very small quantities of paint is desirable. In respect of the time-restricted processability of "opened" quantities of paint or supplies of paint, in particular the waste associated with frequent colour changes and the concomitant rinsing procedure of the paint lines can be a problem and can result in an undesirable extra expenditure during operation of the painting system.

The object of the invention is therefore to provide a paint-spray line of the type mentioned above which, to a particular extent and while keeping the expenditure particularly low, is also suitable for a need-based provision of individual quantities of paint which are kept at a particular minimum This object is achieved according to the invention in that the conveying device, provided for feeding the paint into the main supply line, is configured as a single-piston pump.

In this respect, the invention proceeds from the consideration that the operational expense can be kept particularly low during the provision of very small individualized quantities of paint, in that the possibly resulting wasted paint which is present particularly as residual quantities of paint resulting when the colour is changed and is to be discarded, is consistently avoided or is at least minimised. For this purpose, the entire painting system should consequently be configured such that the quantity of paint required in the system due to operating conditions is kept to a particular minimum. For this purpose, provision is made in particular to substantially configure the conveying device itself for feeding the paint out of the reservoir into the main supply line such that, as far as possible no amount of paint or only small amounts of paint are required to maintain operation in the conveying device. To accommodate this aspect, the conveying device or the feed pump should be specifically configured such that it can be completely or at least substantially completely emptied of residual quantities of paint, and that all quantities of paint present in the conveying device can be conveyed out into the main supply line, without impairing the operational reliability of the conveying device. To accommodate this measure, the conveying device should be configured as a metering cylinder or also as a single-piston pump.

In addition to this, in a particularly advantageous configuration, the main supply line is configured as what is known as a piggable line, in which, while drawing on the pigging method, known for example from EP 1 142 649 B1, a "package-wise" or need-based coating by the main supply line with individualized quantities of paint adjusted to the determined requirement is possible. In a combined system of this type, the conveying device advantageously feeds the quantity of paint, determined individually and according to requirements, into the main supply line, while substantially avoiding residual amounts of paint remaining in the conveying device, and after the paint has been fed into the media-side termination of the thus formed paint package, a pig is introduced into the main supply line. The pig is used as a separating agent for reliably delimiting the paint package from a propulsion medium or the like, which is subsequently fed into the main supply line and by which the pig and thereby the paint package positioned in front of it is conveyed further in the main supply line in the conveying direction and is finally conveyed to the junction of the respective branch line of the selected sprayer. Thus, due to a combined configuration of this type, both the operation of the conveying device and the operation of the main supply line are substantially possible, without resorting to additional quantities of paint to maintain the operation of the respective components.

Furthermore, to also allow a particularly situation-adapted mode of operation of the conveying device and in this respect, for example, to be able to appropriately differentiate between a suction mode and an operating mode or the like, alternatively or additionally in an advantageous development the conveying device can be controlled and is configured for differently selectable conveying rates.

A further adaptation of the painting system to the requirements of a reliable provision of even very small quantities of paint can be achieved in that the single-piston pump is advantageously configured for a conveying pressure of at least 10 bar. When presetting a selected, comparatively high conveying pressure of this type, it is particularly considered that even with the smallest quantities of paint, a specific supply of the respective paint package to individual removal stations, i.e. in particular to the respective junctions of the branch lines associated with the individual sprayers, should be possible. To accommodate this, the length of the respective paint package in the line system should be long enough to ensure that the paint package is positioned reliably along the supply line. This is advantageously considered in the case of comparatively minimised quantities of paint and of a low volume, produced thereby, of the respective paint package, in that the main supply line is configured with a comparatively minimised line cross section, so that even a small-volume paint package has a particular length in the line. To be able to ensure a reliable transportation of the paint packages, also in respect of the increased flow resistance, caused thereby, in the respective line, the outlet pressure or conveying pressure of the single-piston pump should be chosen in a correspondingly appropriate manner.

A particularly reliable and metered discharge even of very small quantities of paint into the main supply line can be achieved in that, in an advantageous development, the single-piston pump, provided and configured as a metering cylinder, is suitably combined with a sensor system for a comparatively highly accurate determination of the quantity of paint delivered by the feed pump and fed into the main supply line. To make this possible, in a particularly advantageous configuration, the single-piston pump configured as a metering cylinder is for its part configured as an appropriate paint quantity sensor in that a distance sensor for determining the piston position inside the single-piston pump is provided. By determining the piston position and by tracking the change in position during the feed of paint, it is thus possible for the quantity of paint discharged into the main supply line by the metering cylinder or the single-piston pump to be determined in a comparatively highly accurate manner, while considering the other configuration values (such as in particular the piston diameter and the like). In this respect, in particular the movement increments of the pump or of the pump piston can be detected sensorially and can be evaluated as conveyed quantity signals. In an alternative or additional advantageous development, connected downstream of the single-piston pump on the conveying side is a flow sensor, and thus the quantity of paint conveyed out of the feed pump can also be reliably determined by this flow sensor.

To allow accurately measured quantities of paint to be delivered in a metered manner from the conveying device with even greater reliability, the system is advantageously configured for a suitable recognition of the starting time of the actual conveying procedure. In this respect, in particular it can be acknowledged that even when small quantities of paint are provided, first of all, after a reservoir having the required paint in the desired shade has been appropriately provided, a suction procedure is necessary by which the paint is supplied to the conveying device. On the conveying side, this means that initially on the conveying side of the pump, air is released which can be delivered, for example, to a suitable ventilation means, before paint is delivered by the feed pump in the transition into the actual conveying phase. To be able to reliably establish this transition and thereby the start of the actual paint feed into the main supply line, the single-piston pump is advantageously provided on the conveying side with a pressure sensor for determining the conveying pressure. In this respect, it is acknowledged that the paint actually to be conveyed is incompressible compared to compressible air, so that the start of the actual paint feed into the main supply line can be established by means of a rise in pressure on the conveying side of the pump.

To appropriately utilise the start of the paint feed, established by means of the rise in pressure, into the main supply line in an associated automation system or in another appropriate manner in the installation, in a further advantageous configuration, associated with the pressure sensor is a signal transmitter which, if a clearly recognisable rise in the conveying pressure of more than 10% is established, outputs a suitable manipulated variable or, subject to state, outputs a manipulated variable such that it is possible, using the manipulated variable, to differentiate between the states "conveying pressure greater than the limiting value" on the one hand and "conveying pressure lower than the limiting value". The increase in the conveying pressure is respectively dependent on the diameter of the line to be filled, on the viscosity of the medium to be conveyed and on the respective conveyed quantity. For this purpose, a limiting value of 0.5 bar, particularly preferably of 1 bar is advantageously chosen, so that it allows a reliable differentiation to be made between the state "air on the conveying side of the pump" on the one hand and "paint on the conveying side of the pump" on the other, while considering these respectively differently occurring parameters, and so that a reliable consideration of the starting of the paint conveyance is possible.

The control signal emitted by this signal transmitter can be suitably further processed in the entire installation, for example within an automation system, and can be used for the system control. However, a direct use of this control signal for system control is also advantageously provided in that an automatic switchover from "ventilation mode" to "operating mode" occurs when this control signal appears. For this purpose, to identify the control signal, the signal transmitter is advantageously connected on the signal side to a switching unit associated with the branch-off point of a vent line from a paint line connected downstream of the single-piston pump on the conveying side.

A particularly compact and thereby also material-saving construction of the paint-spray line can be achieved in that, in an advantageous development, basic components of the paint supply unit are configured as an integrated unit. For this purpose, advantageously directly connected to the single-piston pump on the conveying side is a distributor block, in which the conveying line of the single-piston pump branches into a connecting line for the main supply line on the one hand and into a vent line on the other. The compact and integrated construction can be achieved to an even greater extent in that, in a further advantageous configuration, the pressure sensor and optionally the switching unit for the branch-off point of the vent line from the main supply line are also integrated into the distributor block.

In a further advantageous configuration, the paint-spray line is also upgraded for the processing of very small quantities of paint, in that the suction system of the single-piston pump is specifically configured for also processing very small quantities of paint. For this purpose, the suction line of the single-piston pump is advantageously configured for a total length, kept particularly short, of at most 200%, particularly preferably at most 150%, of the height of the reservoir, it being particularly considered that the suction line should be shorter than double the height of the reservoir provided for the supply of the paint. In particular, the suction line should have a diameter of not more than 25 mm. Furthermore, the suction line should be selected to be exchangeable and, in respect of the material choice thereof and dimensioning, particularly in respect of the internal diameter, should be adapted to the viscosity of the paint to be conveyed. When selecting the internal diameter, while considering the viscosity of the quantity of paint to be conveyed, the requirements, conditioned thereby, in respect of suction pressure and the like are advantageously taken into account.

To particularly minimise the waste and the residual quantities of paint which result during the processing of the quantities of paint and are eventually to be discarded, in a further advantageous configuration, the paint-spray line is provided to a particular extent for the most comprehensive and virtually residue-free emptying of the paint containers, in which the paint to be processed is supplied. To make this possible, a suction pipe which is connected to the suction line of the single-piston pump and is introduced into the paint container for taking up the paint is advantageously provided on its free end with a return stop. This return stop can be configured, for example, as a suitable check valve, as a ball check valve or the like and is advantageously arranged in the immediate end region of the suction pipe.

Additionally or alternatively, an advantageous development provides the specific collection in the paint container of residual quantities of paint, which may still be present, in a selected base region of the paint container, preferably in the immediate vicinity of the free end of the suction pipe, so that these residual quantities of paint can also be conveyed out into the pump. To make this possible, in an advantageous configuration, a receiving unit, associated with the single-piston pump, for a paint container is configured such that it can swivel. This configuration means that the paint container can be tilted, as required, so that the residual paint which is still in the container collects in a restricted spatial region at the base of the container. Alternatively or additionally, for example by a sufficiently long configuration of the suction pipe, it can also be provided that when the suction pipe is pushed into the paint container, as a result of mechanical contact with the suction pipe, a deformation is produced in the base region of the paint container, which deformation can serve as a collecting area for residual quantities of paint. To make this possible, the suction pipe is advantageously configured with an adequate length, and has in particular a length of more than the height of the paint container provided for the supply of paint.

In an alternative advantageous configuration, it can also be provided for particularly minimised and thereby low-loss transportation or conveying paths, that the feed pump is directly immersed into the paint container in the manner of an "upside-down operation", so that the paint can be drawn up by suction directly via the inflow region of the pump without the necessity of a further suction line. In this respect, the feed pump is expediently and appropriately positioned in height corresponding to the liquid level inside the paint container, the positioning being appropriately re-adjusted as the paint is progressively removed from the paint container, so that the inflow region of the feed pump always immerses precisely into the liquid surface. To make this possible, in an advantageous configuration, the single-piston pump can swivel in its longitudinal axis about a swivel axis of at least 180°, or is also rigidly installed directly above the reservoir with the suction side downwards, thereby enabling the mentioned "upside-down operation".

With this type of operation, the suction line can be significantly shortened and can be configured with a length shorter than the overall height of the reservoir. In this case, the suction line is immersed into the paint (the liquid to be conveyed) with an immersion depth of only a few centimeters and the distance of the pump from the liquid level and/or the distance of the cover plate from the liquid is measured using a distance sensor. In this respect, the sensor can be configured as an optical, acoustic, electric or inductive sensor, preferably as a hydrostatic sensor, as an ultrasound system, as a guided microwave or particularly preferably as a capacitive sensor. With the evaluation of this signal, the pump or the suction line thereof or also the container per se tracks the liquid level which falls while the contents of the container are removed by suction, by a motor-driven positioning means, so that the lower end of the suction line always remains below the liquid level. This configuration means that the length of the suction line can be less than the filling level of the liquid in the reservoir; with an appropriate choice of the distance sensor and of the control parameters of the positioning means, it is even possible for the suction line to only be a few centimeters long. Consequently, the contents of the suction line and thus the filling quantity, which cannot be used for painting, of the paint conveying device can be further minimised. In the case of "upside-down operation" of the single-piston pump, the conveying-out of the suctioned paint (the liquid), or the guidance of the vent line can take place centrally through the piston rod of the pump, so that the air which is unavoidably also drawn up by suction during the first suctioning procedure of the liquid can escape upwards above the liquid in the pump cylinder.

The advantages which are achieved with the invention are particularly that, as a result of the configuration of the conveying device provided for feeding paint into the main supply line, as a single-piston pump, particularly in combination with the further provided sensors on the one hand and measures for minimising the so-called "dead" volumes, i.e. volumes required for maintaining the operational procedures, on the other, the residual quantity of paint required for maintaining the operational procedures in addition to the quantity of paint to be discharged can be kept at a particular minimum and the paint can be fed particularly in line with demand. Thereby, even when extremely small quantities of paint are required in individual cases and when colour changes are often necessary, the paint consumption of the entire system and the production of waste or of no longer usable residual paint can be kept particularly low.

Figure 3:
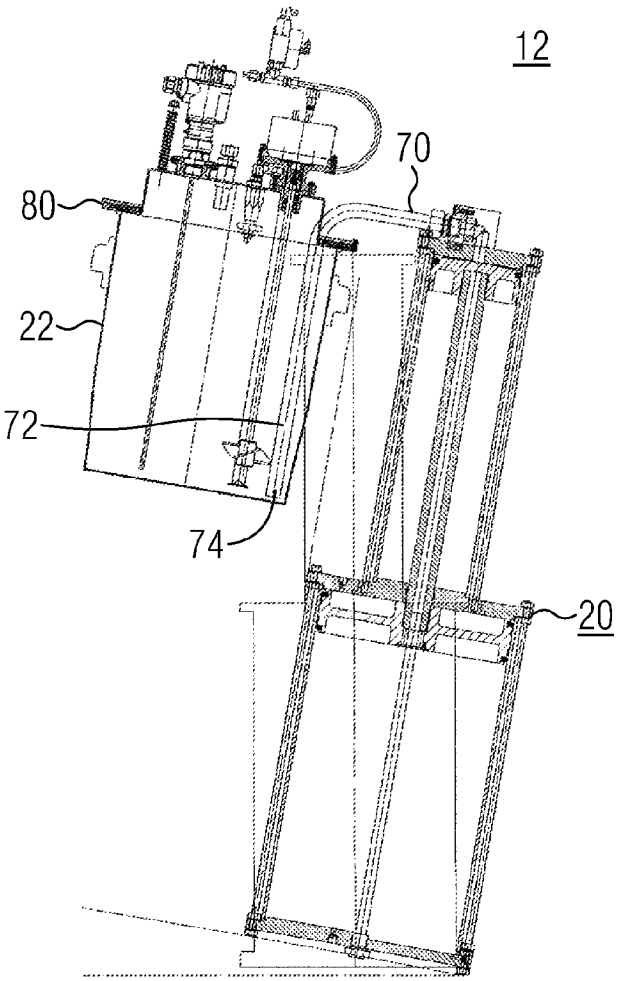
Figure 2:
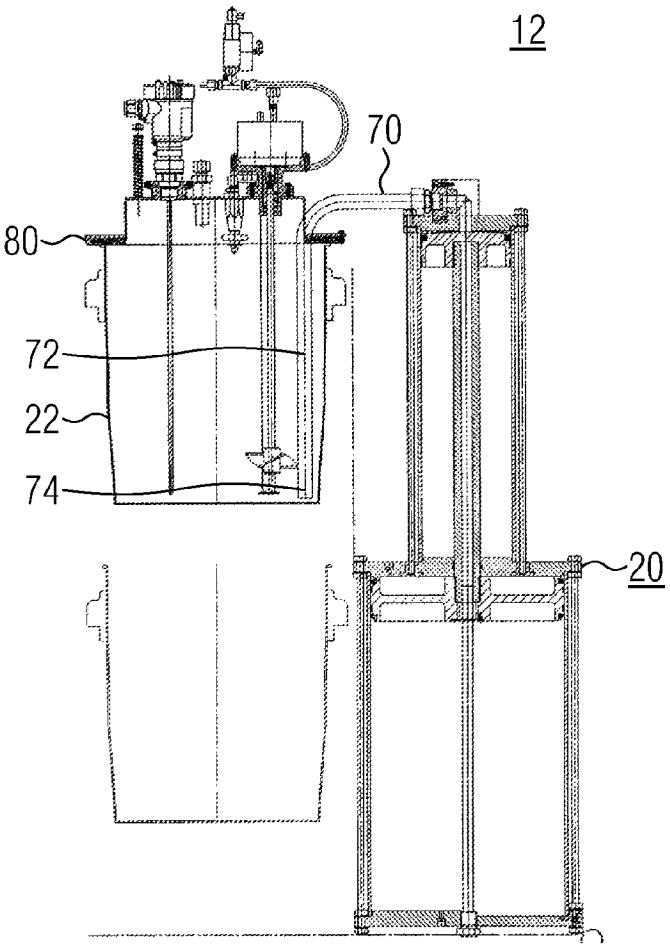
Figure 4B:
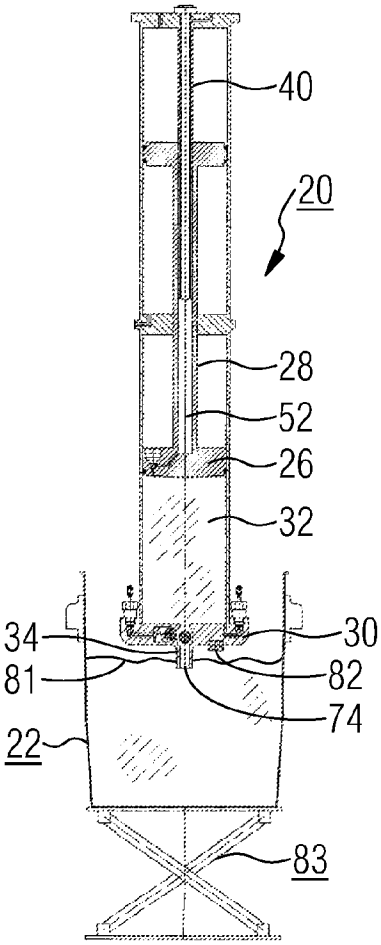
Figure 4A:
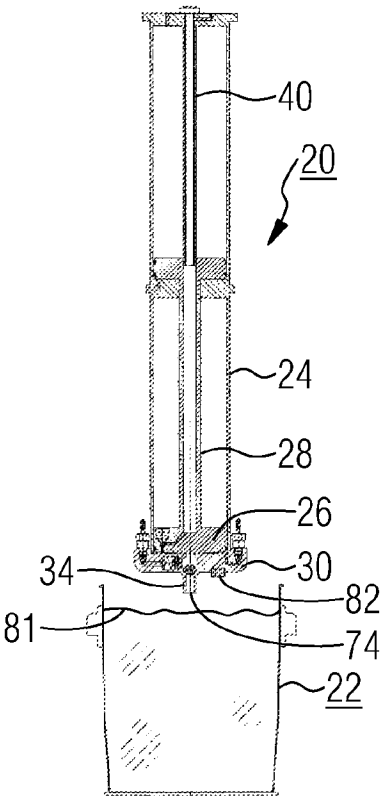

An embodiment of the invention will be described in more detail with reference to drawings, in which:

FIG. 1 schematically shows a paint-spray line;

FIG. 2, 3 show details of a paint supply unit of the paint-spray line according to FIG. 1, FIG. 4*a*, 4*b* show alternative embodiments of the paint supply unit according to FIG. 2, 3, and FIG. 5*a*, 5*b* show a cover plate.

Identical parts in all the figures are provided with the same reference numerals.

The paint-spray line 1 according to FIG. 1 is configured in the embodiment to have multiple sections, is configured in particular as a two-section line and comprises a first painting section 2 and a second painting section 4. However, the paint-spray line 1 could naturally also be equipped with only a single painting section. To coat items or to apply paint, each painting section 2, 4 respectively comprises a plurality of sprayers 6 which, with the formation of the respective painting section 2, 4, are arranged in tandem, are provided for applying paint onto the coated item and are connected to a paint supply unit 12 common to both painting sections 2, 4 via a main supply line 8 and 10 which is common to the sprayers 6 inside the respective painting section 2, 4. In this respect, in the embodiment, the paint supply to the sprayers 6 is provided via the main supply lines 8, 10 which thus form a supply line system 8, 10 common to the sprayers 6. Alternatively, the supply line system 8, 10 could also be configured as a plurality of individual branch lines or the like which lead to the individual sprayers from a common branching point.

The length of the main supply lines 8, 10 of the painting sections 2, 4 can be freely selected and the main supply lines 8, 10 lead to a number of colour changers 14 which are arranged in a painting booth (not shown) and from which a respective branch line leads to the respective sprayers 6. The main supply line 8, 10 is configured to be piggable in each case and can be formed as a branch or ring line. In this respect, the respective main supply line 8, 10 has at its start or at its conveying pump-side end a respective release valve 56 which is followed by a first parking station 58 for a pig. Provided downstream of the last removal area is a second parking station 59 for the pig, where the pig can let through the fluid which flows past it during normal operation. Connected to the pig parking station is a combination of valves which comprises at least one valve for release into a collecting line or into a collecting container, as well as a valve for rinsing agent and a valve for a propelling medium, preferably compressed air. Otherwise, the respective main supply line 8, 10 is appropriately configured by drawing on the pigging method, as described for example in EP 1 142 649 B1, the disclosure of which in respect of the pigging method used is explicitly fully incorporated by reference.

The paint-spray line 1 is specifically configured to also allow the discharge of very small quantities of paint and is thereby also configured for the need-based coating of very small batches or individual parts, involving a particularly low material consumption, while keeping operational costs particularly low. For this purpose, on the one hand basically the feed of need-based calculated colour or paint packages into the respective main supply lines 8, 10 is provided, using the pigging method, so that residual quantities of paint in the adjoining systems can be kept particularly low. To further improve the reduction, achievable thereby, of the operational effort and material expense, in the paint-spray line 1, the paint supply unit 12 is also configured, however, to a particular extent for the processing of very small quantities, while substantially reducing the ensuing waste, even during frequent colour changes.

For this purpose, on the one hand the paint supply unit 12 is configured to keep to a particular minimum the quantity of paint which is required in the manner of an operating material for maintaining the operational procedures and, on the other hand, the corresponding line volumes and the like are kept comparatively low. To make this possible, the conveying device 20 of the paint supply unit 12 which causes the paint to be fed into the main supply line 8, 10 from a paint container 22 provided for the paint supply, is configured as a single-pump piston 20. The single-pump piston 20 is configured for a conveying pressure of at least 10 bar, so that line cross sections with comparatively small dimensions can also be reliably fed (filled) with paint. The minimised line cross sections promote the fact that even in the case of restricted volumes of the fed-in paint, an adequate conveying length inside the respective line is traveled by the paint, so that an adequately precise positioning of the respective paint package in relation to the discharge point is possible without an appreciable operational expense.

The single-pump piston 20 comprises a piston 26 which is guided in a cylinder 24 and can be moved inside the cylinder 24 by a piston rod 28. The cylinder 24, the piston 26 and a cover plate 30 form a conveying chamber 32, the volume of which can be varied by moving the piston 26 inside the cylinder 24. The conveying chamber 32 is connected on the suction side to the interior of the paint container 22 via a suction system 34 and is connected on the conveying side to the main supply line 8 and 10.

The configuration of the conveying device 20 of the supply unit 12 as a single-piston pump ensures that the suctioned quantities of paint brought into the conveying chamber 32 can be fed virtually completely and without residue into the main supply lines 8, 10. In this respect, a comparatively very precise discharge of precisely metered quantities of paint is made possible by a correspondingly precise control of the piston position inside the cylinder 24, so that the single-piston pump 20 can also be used in the manner of a metering cylinder for a very precise paint feed. To further improve the accuracy of a specific and need-based paint feed, the paint supply unit 12 is also provided with a number of sensors to accurately determine the delivered quantity of paint.

For this purpose, on the one hand the piston rod 28 of the single-piston pump 20 is provided with a distance sensor 40. Said distance sensor 40 makes it possible to very accurately determine the piston position inside the cylinder 24, from which it is possible to precisely determine the given paint volume, while considering the other configuration parameters, such as in particular the cylinder cross section. In particular, the movement increments of the piston 26 in the single-piston pump 20 can be detected sensorially and can be evaluated as conveyed-quantity signals.

Alternatively or additionally, on the conveying side, a flow sensor can also be connected downstream of the single-piston pump 20 to determine the conveyed-out quantity of paint. Flow sensors of this type, which are not shown in the embodiment, can be associated in particular with the connection lines 36, 38.

To be able to detect and determine the discharged quantity of paint in a particularly precise sensorial manner, in a starting procedure of the paint transportation, as often occurs when there are frequent colour changes, the time at which paint starts to be fed into the main supply lines 8, 10 is also automatically recorded. In this respect, it is specifically taken into account that during the suctioning procedure and before the start of the actual paint transportation, the single-piston pump 20 only releases air on the conveying side first of all and as long as the conveying volume 32 has not been completely filled with paint. Since air is a compressible medium, whereas the paint to be conveyed is incompressible, the commencing discharge of paint on the conveying side of the single-piston pump 20 results in a corresponding increase in pressure in the conveying chamber 32 of the single-piston pump 20 at the moment when the conveying chamber 32 is completely filled with paint. To be able to suitably determine this moment, a pressure sensor 46 for determining the conveying pressure is associated with the single-piston pump 20 on the conveying side.

Associated with the pressure sensor 46 is a signal transmitter 48. The signal transmitter 48 is configured to output a control signal in the event that the conveying pressure exceeds a limiting value, which can be adjusted in a system-dependent manner, of 0.5 bar, for example. Thus, by presetting this limiting value, the control signal emitted by the signal transmitter 48 is characteristic of a differentiation as to whether or not the conveying chamber 32 of the single-piston pump 20 is completely full of paint. The control signal can therefore be used for a corresponding recognition of the start of the actual conveying of the paint.

This control signal can be evaluated in an automation unit or in a central control station for the paint-spray line 1. However, in the embodiment, it is provided in the sense of an additional and further integration of the system procedures in the manner of an automated utilisation of this control signal that the operating state of the paint-spray line 1 switches over from "ventilation" to "paint conveyance" directly subject to this control signal. For this purpose, for transmitting the control signal the signal transmitter 48 is connected on the signal side to a switching unit 56 associated with the branch-off point 50 of a vent line 52 from a paint line 54 connected downstream of the single-piston pump 20 on the conveying side.

The paint supply unit 12 is also configured for an integrated and thus particularly compactly maintained construction. For this purpose, directly connected to the single-piston pump 20 on the conveying side is a distributor block 60, in which the conveying line of the single-piston pump 20 branches into the connecting lines 36, 38 for the main supply lines 8, 10 on the one hand and branches into the vent line 52 on the other. The distributor block 60 is directly flange-mounted onto the single-piston pump 20 for an integrated and compact construction, which cannot be seen in FIG. 1 due to the schematic illustration. Further valves for rinsing agent, compressed air and/or for the release of various rinsing or ventilation paths are arranged in the distributor block 60, depending on requirements.

To further reduce the residual quantities of paint which have to be accepted, the suction system 34 of the supply unit 12 is also configured appropriately. In particular, the suction system 34 of the single-piston pump 20 has suction pipe 72 which is connected via a suction line 70 to the conveying chamber 32 of the single-piston pump 20. The suction line 70 is kept particularly short, so that the corresponding volumes can be kept particularly low, and it has a length of at most 200% of the height of the reservoir. The suction line 70 is thereby particularly shorter than double the height of the container 22. Furthermore, the suction pipe 72 is also appropriately configured in respect of the discharge of very small residual quantities from the paint container 22 and, for this, it has at its free end 74 a return stop, particularly in the form of a check valve, preferably a ball check valve. Furthermore, the suction pipe 72 can also be configured to discharge a remaining residual quantity of paint during emptying of the container 22, for example by a piston guided in the suction pipe 72 or by a ball floating therein which transfers the residual quantity of paint remaining inside the suction pipe 72 into the conveying volume 32.

In respect of the choice of material for the suction pipe 72, said suction pipe 72 is also of an adequately rigid construction and is calculated in length such that it exceeds the overall height of the container 22 such that, when the suction pipe 72 immerses into the paint container 22, a local deformation of the container base by the free end 74 of the suction pipe 72 is made possible. Thus, during immersion of the suction pipe 72 into the paint container 22, a local depression in the container base can be produced in which residual quantities of paint can collect, thereby furthering a specific discharge of even very small residual quantities of paint. The suction system 34 also comprises at least one release valve 35, the opening of which can clear the suction line to the conveying chamber 32. The release valve 35 is closed when the paint in the conveying chamber 32 is to be pushed again in the direction of the connecting line. Compactly connected to the output system 34 is a valve unit 31 into which are integrated different valves, by which the output system 34 and the path to and in the distributor block 60 can be rinsed. Contained in the valve unit 31 are at least valves for supplying rinsing agent and compressed air, and also, if required, release valves for the choice of rinsing paths and/or associated pump valves which conduct the soiled rinsing agent into disposal lines.

Details of the paint supply unit 12 are presented in FIGS. 2 and 3. As shown by these figures, the paint supply unit 12 and therewith also a receiving unit 80, associated with the single-piston pump 20, for the paint container 22 can swivel in the longitudinal axis. Starting from a straight starting position, as shown in FIG. 2, by swiveling the entire system, a tilted position, as shown in FIG. 3, can be adjusted if required. This tilting movement ensures that small residual quantities of paint remaining in the container 22 collect in the base region in the immediate vicinity of the free end 74 of the suction pipe 72, so that the tilting movement promotes a specific discharge of even very small residual quantities of paint.

Alternatively, the single-piston pump 20 for its part can advantageously swivel with a swivel range of at least 180°, or can be installed in a fixed "upside-down" position, as shown in FIG. 4. Thereby, the adjustment of an "upside-down" position for the single-piston pump 20 is possible, so that the single-piston pump 20 can be directly immersed with its suction region in the container 22, while dispensing with a longer suction line or the like. By appropriately re-positioning the single-piston pump 20 in relation to the respective liquid level of the paint in the paint container 22, a reliable discharge of the paint is thereby particularly promoted.

As shown in FIGS. 4*a* and 4*b*, the suction line 34 can be significantly shortened and can be configured with a shorter length than the overall height of the reservoir 22. In this case, the suction line is immersed into the paint (the liquid to be conveyed) with an immersion depth of only a few centimeters and the distance of the pump from the liquid level 81 is measured using an optical, acoustic, electric or inductive distance sensor 82. With the evaluation of this signal, the pump or the suction line thereof tracks the liquid level 81, which falls as the contents of the container are removed by suction, by a motor-driven positioning means 83, so that the lower end of the suction line 74 always remains below the liquid level. This configuration means that the length of the suction line 34 can be significantly less than the filling level of the liquid in the reservoir. In the case of "upside-down operation" of the single-piston feed pump, the discharge of the suctioned paint (liquid), or the guidance of the ventilation valve 52 can take place centrally through the piston rod of the pump, so that the air which is unavoidably also drawn up by suction during the first suctioning procedure of the liquid can escape upwards above the liquid in the conveying chamber 32 of the pump.

In this respect, the positioning means 83 can be directly associated with the pump or with the suction line thereof and can suitably track them according to the change in height of the liquid level 81. However, in the embodiment, the positioning means 83 is associated with the reservoir 22 in the manner of a telescopically extensible support mechanism, so that the height thereof can be appropriately adjusted to the position of the pump.

Figure 5A:
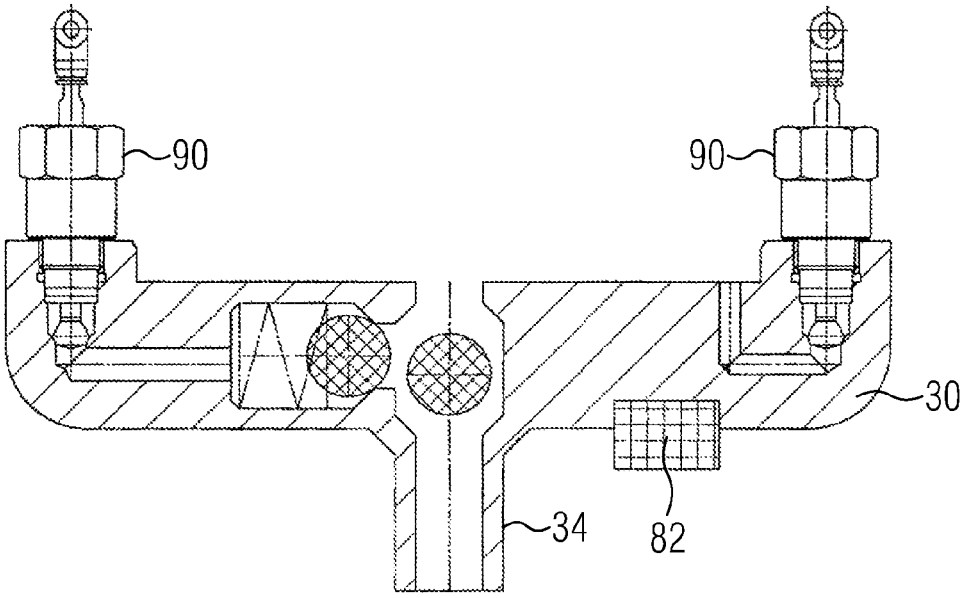
Figure 5B:
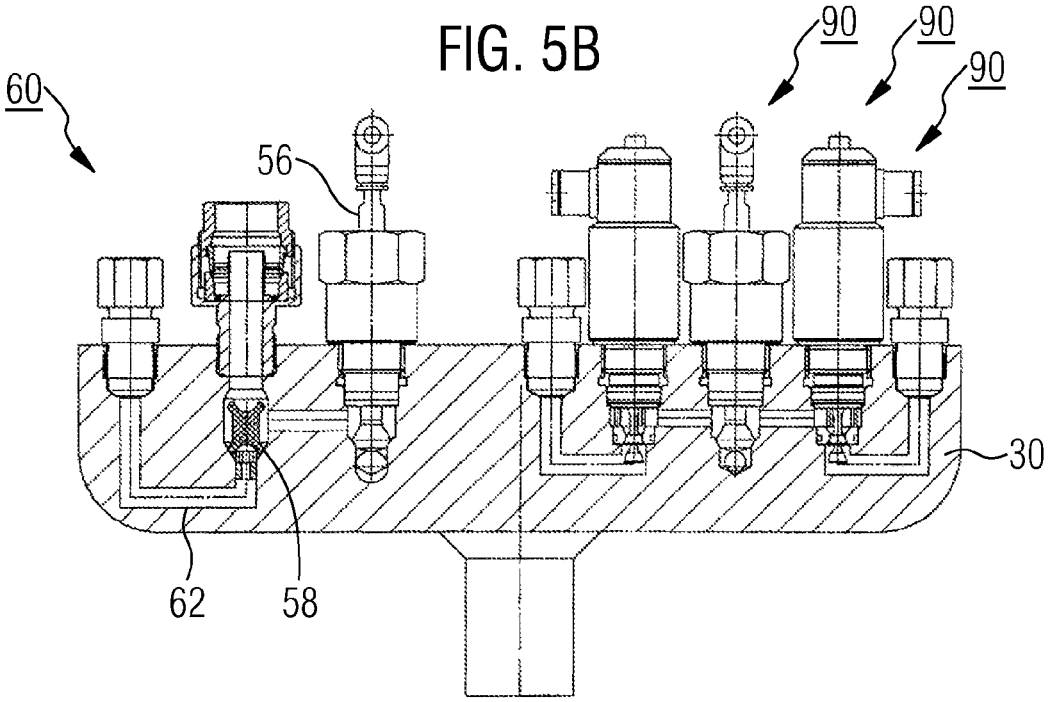

FIG. 5*a*, 5*b* are respective longitudinal sectional views of the cover plate 30, as configured in particular for upside-down operation of the single-piston pump. In a particularly advantageous configuration, as shown in FIG. 5*a*, 5*b*, integrated into the cover plate 30 are valves and connections 90 for branch lines which are contained in the distributor block 60 in the embodiment according to FIG. 1. This configuration allows a positioning of the junctions for the branch lines and/or of the distributor block 60 in the immediate vicinity of the single-piston pump 20, which again requires a very compact construction with correspondingly short conveying paths. Furthermore, a pig launching station can also be integrated into the cover plate 30.

LIST OF REFERENCE NUMERALS

1 paint-spray line
2,4 painting section
6 sprayer
8, 10 main supply line
12 paint supply unit
14 colour changer
20 single-piston pump
22 paint container
24 cylinder
26 piston
28 piston rod
30 cover plate
32 conveying chamber
34 suction system
38, 38 connecting line
40 distance sensor
46 pressure sensor
48 signal transmitter
50 branch-off point
52 vent line
54 paint line
60 distributor block
70 suction line
72 suction pipe
74 free end
80 receiving unit
81 liquid level
82 distance sensor
83 positioning unit for pump/container distance

The invention claimed is:

1. A paint-spray line, comprising:

a plurality of sprayers configured to discharge paint onto an item to be coated, the plurality of sprayers in fluid communication with a paint supply;

a conveying device provided to feed the paint supply to the plurality of sprayers, wherein the conveying device includes a single-piston pump;

a paint container comprising the paint supply, the paint container is connected to a receiving unit associated with the single-piston pump, wherein the paint container is configured to swivel about a longitudinal axis;

a conveying line directly connected to a conveying side of the single-piston pump of the conveying device and to a first connection of a distributor block, wherein the distributor block is in fluid communication with the conveying device and is configured to receive the paint supply from the conveying device;

a connecting line directly connected to a second connection of the distributor block and to a common supply line system, wherein the plurality of sprayers are directly connected to the common supply line system, and wherein the plurality of sprayers are in fluid communication with the distributor block and are configured to receive the paint supply from the distributor block; and a vent line directly connected to a third connection of the distributor block, wherein the vent line is in fluid communication with the distributor block and is configured to receive the paint supply from the distributor block.

2. The paint-spray line according to claim 1, wherein the single-piston pump is configured for a conveying pressure of at least 10 bar.

3. The paint-spray line according to claim 1, wherein the single-piston pump is provided with a distance sensor for determining a piston position.

4. The paint-spray line according to claim 1, wherein a flow sensor is connected downstream of the single-piston pump of the paint spray line on the conveying side.

5. The paint-spray line according to claim 1, wherein the single-piston pump is provided with a pressure sensor on the conveying side for determining a conveying pressure of the single-piston pump.

6. The paint-spray line according to claim 5, wherein a signal transmitter, associated with the pressure sensor, is configured to output a control signal if the conveying pressure exceeds a limiting value of 0.5 bar.

7. The paint-spray line according to claim 6, wherein, to transmit the control signal, the signal transmitter is connected to a switching unit associated with a branch-off point of the vent line from the conveying line.

8. The paint-spray line according to claim 1, wherein a suction pipe connected to a suction line of the single-piston pump is provided with a return stop on a free end of the suction pipe.

9. The paint-spray line according to claim 1, wherein a suction pipe connected to a suction line of the single-piston pump has a length of more than a height of the paint container comprising the paint supply.

10. The paint-spray line according to claim 1, wherein the single-piston pump can swivel in its longitudinal axis about a swivel angle of at least 180°.

11. The paint-spray line according to claim 10, wherein a suction pipe of the single-piston pump is shorter than a filling level of the paint container comprising the paint supply.

12. The paint-spray line according to claim 10, further comprising a sensor which constantly measures a distance of the single-piston pump from a liquid level.

13. The paint-spray line according to claim 10, wherein a position of the single-piston pump, of a suction pipe and/or of the paint container relative to a filling level in a reservoir, which decreases during suction-removal, is automatically tracked.

14. The paint-spray line according to claim 1, wherein the common supply line system forms a loop.

15. The paint-spray line according to claim 14, wherein the common supply line system is configured to circulate paint in one direction through the loop.

16. The paint-spray line according to claim 1, wherein the common supply line system is a plurality of branch lines, and wherein each branch line corresponds to a paint sprayer in the plurality of paint sprayers.

17. The paint-spray line according to claim 1, further comprising:

a second plurality of paint sprayers directly connected to a second common supply line system; and a second connecting line directly connected to a fourth connection of the distributor block and to the second common supply line system, wherein the second plurality of sprayers are in fluid communication with the distributor block and are configured to receive the paint supply from the distributor block.

* * * * *